US006786300B1

(12) United States Patent
Bonifacini

(10) Patent No.: US 6,786,300 B1
(45) Date of Patent: Sep. 7, 2004

(54) STEP ATTACHMENT FOR LADDERS

(76) Inventor: Raymond Perez Bonifacini, 11618 Hazen, Houston, TX (US) 77072

( * ) Notice: Subject to any disclaimer, the term of this patent is extended or adjusted under 35 U.S.C. 154(b) by 0 days.

(21) Appl. No.: 10/371,004

(22) Filed: Feb. 20, 2003

Related U.S. Application Data

(60) Provisional application No. 60/357,794, filed on Feb. 20, 2002.

(51) Int. Cl.[7] ..... E06C 7/16

(52) U.S. Cl. ..... 182/120; 182/121; 182/122; 248/236

(58) Field of Search ..... 182/118, 120, 182/121, 122, 166, 167; 248/238

(56) References Cited

U.S. PATENT DOCUMENTS

| | | | | | |
|---|---|---|---|---|---|
| 335,051 | A | * | 1/1886 | Ayres | 182/120 |
| 1,820,315 | A | | 8/1931 | Miller | |
| 2,066,108 | A | * | 12/1936 | Hedges | 182/25 |
| 2,418,597 | A | * | 4/1947 | Neff | 182/116 |
| 2,444,096 | A | * | 6/1948 | Faust | 220/570 |
| 2,486,783 | A | | 11/1949 | Hartman et al. | |
| 2,805,104 | A | * | 9/1957 | Herman | 182/120 |
| 3,020,972 | A | * | 2/1962 | Hockett | 182/15 |
| 3,115,214 | A | | 12/1963 | Roberts | |
| 3,294,197 | A | * | 12/1966 | Kwiatkowski | 182/120 |
| 3,422,923 | A | * | 1/1969 | Lund | 182/120 |
| 4,437,544 | A | * | 3/1984 | Anderson et al. | 182/120 |
| 4,586,586 | A | | 5/1986 | Canals | |
| 4,911,265 | A | | 3/1990 | Skaggs | |
| 5,056,620 | A | | 10/1991 | Zumwalt et al. | |
| 5,158,023 | A | * | 10/1992 | Allen | 108/42 |
| 5,337,857 | A | | 8/1994 | Spalt et al. | |
| 5,460,241 | A | * | 10/1995 | LaBelle | 182/214 |
| 5,975,240 | A | * | 11/1999 | O'Brien | 182/122 |
| 6,467,577 | B1 | * | 10/2002 | Charlebois, Jr. | 182/129 |
| 6,637,548 | B2 | * | 10/2003 | Pass | 182/121 |

* cited by examiner

*Primary Examiner*—Bruce A. Lev
(74) *Attorney, Agent, or Firm*—Kenneth A. Roddy

(57) ABSTRACT

A unitary step unit has a generally rectangular main body portion with opposed transverse ends and laterally opposed sides. One end is bent downward and angularly outward with respect to the main body portion and terminates in a short upturned lip that extends angularly upward and inward. The step unit is removably installed on the existing step of a conventional ladder having channel-shaped steps by engaging the upturned lip against the bottom edge of the down-turned longitudinal side of the step and then pivoting the unit downwardly such that the upturned lip of the unit is captured on the bottom edge of the down-turned longitudinal side of the step and its main body portion is supported on top of the step and extends a distance rearwardly beyond the width of the step in cantilever fashion to provide a relatively wide flat foot-supporting surface.

9 Claims, 3 Drawing Sheets

STEP ATTACHMENT FOR LADDERS

CROSS REFERENCE TO RELATED APPLICATION

This application claims priority of U.S. Provisional Patent Application Serial No. 60/357,794, filed Feb. 20, 2002.

BACKGROUND OF THE INVENTION

1. Field of the Invention

This invention relates generally to ladder steps, and more particularly to a unitary step attachment adapted to be releasably mounted on the step of a conventional ladder for increasing the width of the existing step.

2. Brief Description of the Prior Art

Steps on a conventional ladder are narrow and do not provide a very satisfactory foot support, especially when prolonged standing on a single step is required. Various step attachments are known in the prior art which are adapted to be mounted on a conventional ladder for increasing the width of the existing step. Most of these prior art devices are complex and require fasteners to secure them to the side rails, rung, or step of the ladder, and are not easily installed and removed.

Some prior art patents have a fault wherein the platform upon which the user may place his feet, extends either in front of the rung, or immediately over it, presenting a potential hazard by which the user may trip. For example, Miller, U.S. Pat. No. 1,820,315 discloses a step attachment for ladders with a platform that hangs off of the rung, and in front thereof.

Hartman et al, U.S. Pat. No. 2,486,783 discloses a platform attachment for rung type ladders that is disposed upon the front side of the ladder and over the rung. Also, the platform itself raises the tread for the user above the rung. This could be dangerous in as much as the user might inadvertently miss that spot.

Roberts, U.S. Pat. No. 3,115,214 discloses a portable step attachment for extension ladders which hangs out in front of the ladder and is secured to a rung. The platform has a central portion that is pivotal up and out of the way to permit the user some access around the platform. Roberts thereby acknowledges the difficulty with getting over a platform on a ladder, however he fails to deal with the inherent problem of having the platform in front of the ladder rung.

Skaggs, U.S. Pat. No. 4,911,265 discloses a work-step platform attachment for an extension ladder that has a hooking element which engages a rung of the ladder and a locking element to lock the platform in a first position in which it is aligned with the rung, and a second position in which it is substantially aligned in the plane of the parallel side frames of the ladder.

Canals, U.S. Pat. No. 4,586,586 discloses a work step for an extension ladder having a platform that engages a lower rung of the ladder and brackets for securing it to an upper rung of the ladder. The platform is pivotal about a rung adjacent to the platform, and has a complicated locking mechanism whereby the platform may be held parallel to the side frame of the ladder. The platform extends onto the rung of the ladder and extends slightly forward of it.

Zumwalt et al, U.S. Pat. No. 5,056,620 discloses a step-ladder platform that is particularly adapted for use with channel-type step ladders which provides an enlarged foot-resting platform and has engagement means which prevent lateral (inward or outward) movement and tilting movement in one or both possible tilt directions. In the deployed position, the platform extends inward and outward on both sides of the step and forward of the ladder.

Spalt et al, U.S. Pat. No. 5,337,857 discloses a platform for an aluminum extension ladder that is adjustable upwardly and downwardly, and is pivotally connected between a pair of side frame members slidably mounted on the side rails of the ladder.

The present invention is distinguished over the prior art in general, and these patents in particular by a unitary step unit having a generally rectangular main body portion with opposed transverse ends and laterally opposed sides. One end is bent downward and angularly outward with respect to the main body portion and terminates in a short upturned lip that extends angularly upward and inward. The step unit is removably installed on the existing step of a conventional ladder having channel-shaped steps by engaging the upturned lip against the bottom edge of the down-turned longitudinal side of the step and then pivoting the unit downwardly such that the upturned lip of the unit is captured on the bottom edge of the down-turned longitudinal side of the step and its main body portion is supported on top of the step and extends a distance rearwardly beyond the width of the step in cantilever fashion to provide a relatively wide flat foot-supporting surface.

SUMMARY OF THE INVENTION

It is therefore an object of the present invention to provide a portable step unit that is easily and quickly installed on and removed from the step of a conventional ladder to increase the width of the existing step.

It is another object of this invention to provide a portable step unit that is easily and quickly installed on and removed from the step of a conventional ladder to provide a relatively wide flat foot-supporting surface.

Another object of this invention is to provide a portable step unit that is easily and quickly installed on and removed from the step of a conventional ladder to provide a rigid safe foot-supporting surface.

A further object of this invention is to provide a portable step unit that is easily and quickly installed on and removed from the step of a conventional ladder that is simple in construction, inexpensive to manufacture, and rugged and reliable in operation.

Other objects of the invention will become apparent from time to time throughout the specification and claims as hereinafter related.

The above noted objects and other objects of the invention are accomplished by a unitary step unit having a generally rectangular main body portion with opposed transverse ends and laterally opposed sides. One end is bent downward and angularly outward with respect to the main body portion and terminates in a short upturned lip that extends angularly upward and inward. The step unit is removably installed on the existing step of a conventional ladder having channel-shaped steps by engaging the upturned lip against the bottom edge of the down-turned longitudinal side of the step and then pivoting the unit downwardly such that the upturned lip of the unit is captured on the bottom edge of the down-turned longitudinal side of the step and its main body portion is supported on top of the step and extends a distance rearwardly beyond the width of the step in cantilever fashion to provide a relatively wide flat foot-supporting surface.

DESCRIPTION OF THE PREFERRED EMBODIMENT

Figure 2:
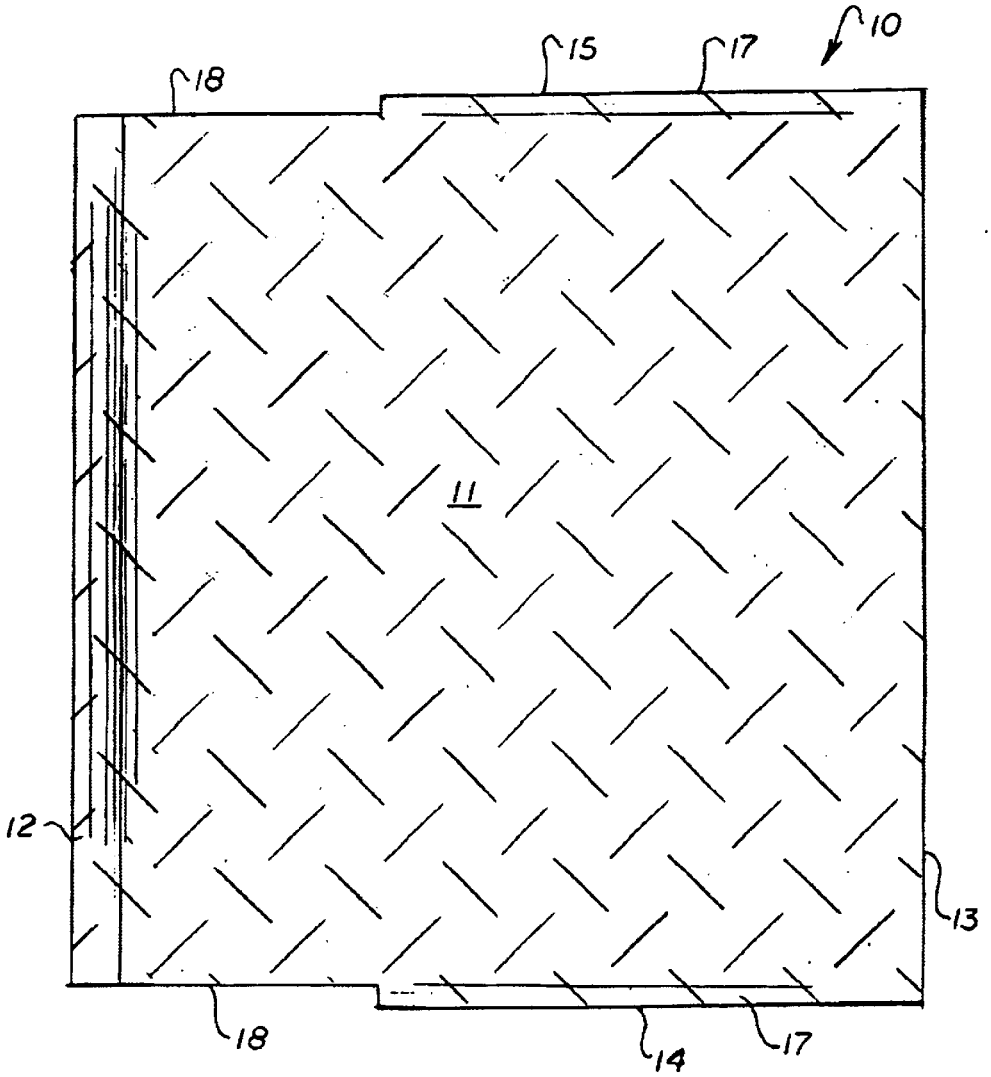
FIG. 2 is a top plan view of the step attachment.
Figure 1:
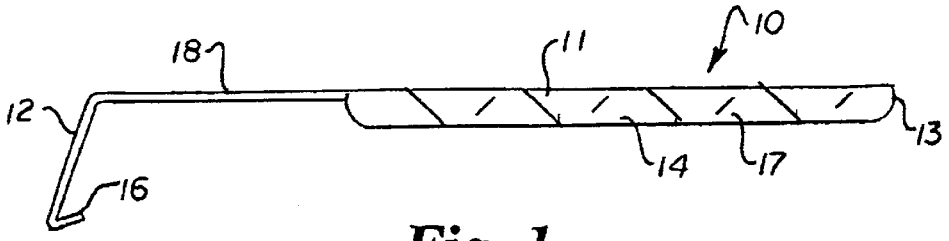
FIG. 1 is a side elevation of the step attachment for ladders in accordance with the present invention.

Referring to the drawings by numerals of reference there is shown in FIGS. 1 and 2, a preferred step unit 10 in accordance with a preferred embodiment of the present invention. The step unit 10 is of single-piece construction and has a generally rectangular flat main body portion 11 with opposed transverse ends 12, 13 and laterally opposed sides 14, 15. One end 12 is bent downward and angularly outward with respect to the main body portion 11 and terminates in a short upturned portion or lip 16 that extends angularly upward and inward with respect to the main body portion and defines a hook portion.

Each of the laterally opposed sides 14, 15, has an elongate longitudinal skirt portion 17 that is bent downwardly a short distance generally perpendicular to the main body portion 11 for stiffening and reinforcing the strength of the step unit 10 to prevent bending. The unbent portion 18 of the laterally opposed sides 14, 15, is dimensioned to be received between the lateral side rails of the stepladder.

The step unit 10 is preferably stamped from sheet metal or heavy gauge aluminum and formed as a single unit. In a preferred embodiment, the step unit 10 is formed of diamond tread aluminum plate approximately 5/32" in thickness, with the diamond tread on the top side of the main body portion 11.

The step unit 10 is designed to be installed on conventional stepladders of the type having a series of steps formed of inverted, generally square U-shaped channels that extend transversly between the lateral side rails of the ladder.

Figure 3:
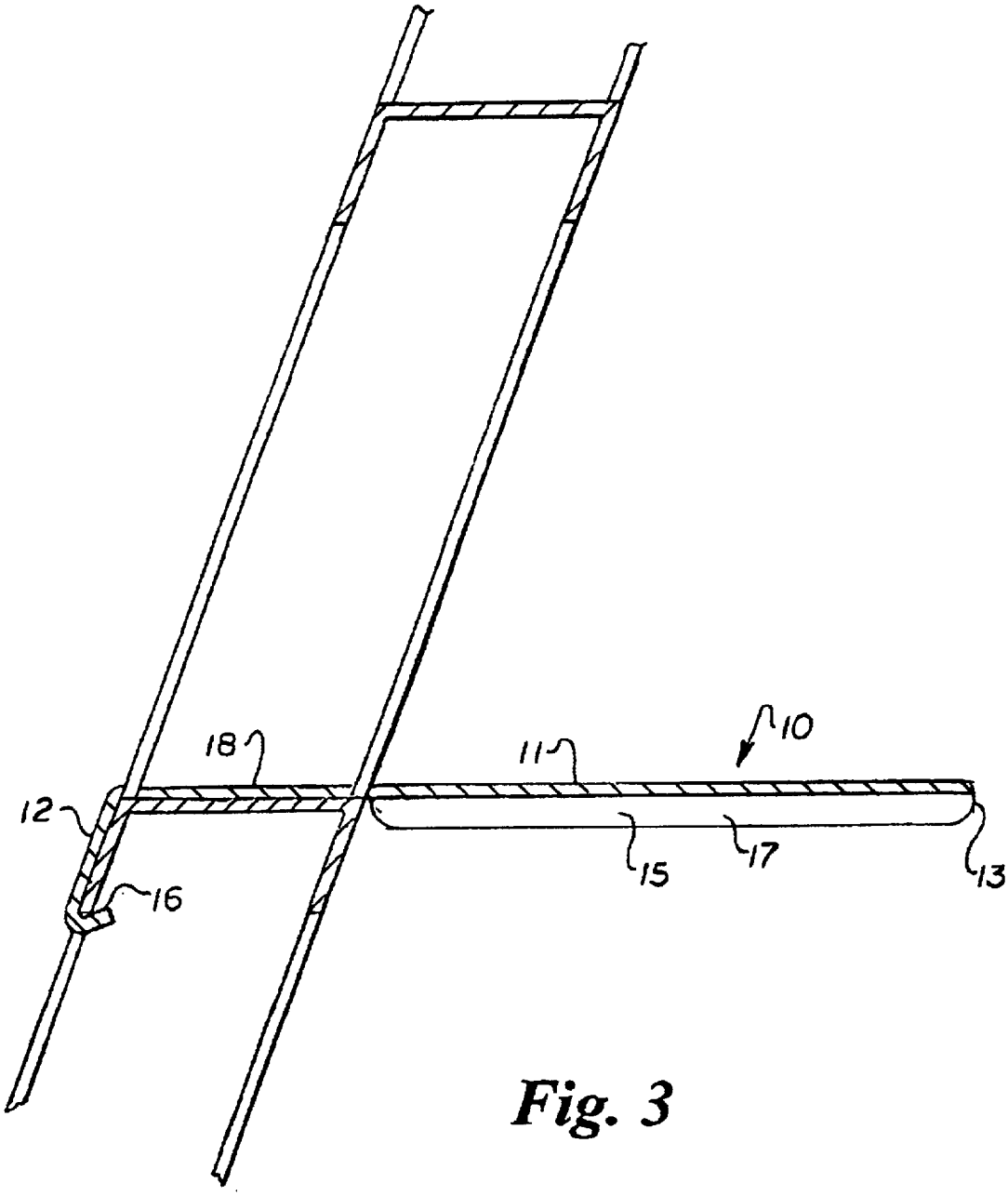
FIG. 3 is a side view in cross section showing the step attachment removably installed on the step of a conventional ladder.
Figure 4:
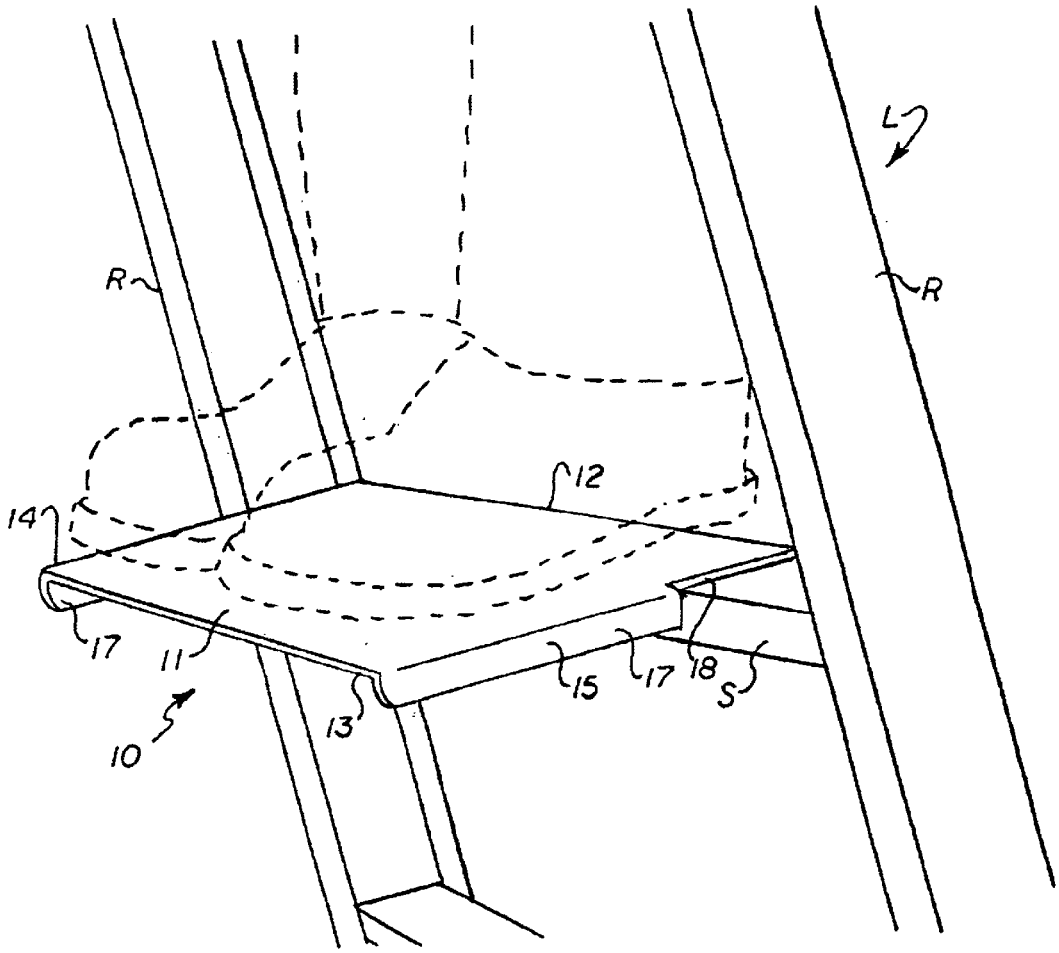
FIG. 4 is a perspective view showing the installed step attachment in use.

As seen in FIGS. 3 and 4, the step unit 10 is removably installed on the existing step s of a conventional ladder L by placing the unbent portion 18 of the laterally opposed sides 14, 15, between the lateral side rails r of the stepladder, engaging the upturned lip 16 of the step unit 10 against the bottom edge of the down-turned longitudinal side of the existing step S, and then pivoting the step unit downwardly such that its main body portion 11 lies on top of the existing step S.

When properly installed, the upturned lip 16 of the step unit 10 is captured on the bottom edge of the down-turned longitudinal side of the existing step S of the ladder and the main body portion 11 is supported on top of the existing step and extends a distance beyond the width of the existing step S in a cantilever fashion to provide a relatively wide flat foot-supporting surface.

While this invention has been described fully and completely with special emphasis upon a preferred embodiment, it should be understood that within the scope of the appended claims the invention may be practiced otherwise than as specifically described herein.

What is claimed is:

1. A unitary foot-supporting platform for attachment to a stepladder a step formed of an inverted generally square U-shaped channel member having a front wall and a top wall supported at lateral ends between lateral side rails of the stepladder, comprising:

a generally rectangular platform adapted at a first end to be engaged and supported on the front wall and top wall of the step and having a generally rectangular main body portion that extends rearward of the step and lateral side rails of the stepladder to provide a platform for supporting the feet of a person standing thereon; and a hook portion at said first end bent downward and angularly outward with respect to said main body portion and terminating in a short upturned portion that extends angularly upward and inward with respect to said main body portion adapted to be engaged with the front wall of the step to prevent forward and rearward movement and tilting of the platform.

2. The unitary foot-supporting platform according to claim 1, wherein said platform is formed of a single piece of rigid material having a generally rectangular flat main body portion with opposed transverse first and second ends and laterally opposed sides.

3. The unitary foot-supporting platform according to claim 2, wherein said first end and said hook portion extend transversely the full width of said platform.

4. The unitary foot-supporting platform according to claim 2, wherein each of said laterally opposed sides has an elongate longitudinal skirt portion that is bent downwardly a short distance generally perpendicular to said main body portion for stiffening and reinforcing the strength of said platform and prevent bending thereof.

5. The unitary foot-supporting platform according to claim 4, wherein each of said laterally opposed sides has an unbent portion with a width dimensioned to be received between the lateral side rails of the stepladder.

6. The unitary stepladder foot-supporting platform according to claim 5, wherein said first end and said hook portion are co-extensive in width to said unbent portion of said laterally opposed sides.

7. The unitary stepladder foot-supporting platform according to claim 2, wherein said platform is formed of a single piece of metal having a tread pattern on a top surface thereof.

8. The unitary stepladder foot-supporting platform according to claim 2, wherein said platform is formed of a single piece of diamond tread aluminum plate material.

9. A method of connecting a removable foot-supporting platform to a stepladder a step formed of an inverted generally square U-shaped channel member supported at lateral ends between lateral side rails of the stepladder, comprising the steps of:

providing a platform of unitary construction having a generally rectangular flat main body portion, opposed transverse first and second ends, and laterally opposed sides, said first end bent downward and angularly outward with respect to said main body portion and terminating in a short upturned hook portion that extends angularly upward and inward with respect to said main body portion;

placing said first end between the lateral side rails of the stepladder; positioning said upturned hook portion beneath a bottom edge of a front wall of the step; and pivoting said main body portion downwardly to engage said upturned hook portion with the bottom edge the front wall of the step, whereby said upturned hook portion is captured on the bottom edge the front wall of the step and said main body portion is supported on a top surface of the step and extends a distance rearward of the step and lateral side rails of the stepladder in a cantilever fashion to provide a platform for receiving and supporting the feet of a person standing on the stepladder.

* * * * *